US008941544B2

(12) United States Patent
Kobayashi et al.

(10) Patent No.: US 8,941,544 B2
(45) Date of Patent: Jan. 27, 2015

(54) VEHICLE ROOF MOUNT ANTENNA

(75) Inventors: Hidekazu Kobayashi, Tokyo (JP); Mitsuo Minakawa, Tokyo (JP); Satoshi Oba, Tokyo (JP); Makoto Hayashi, Tokyo (JP); Toshiro Yokoyama, Tokyo (JP)

(73) Assignee: Harada Industry Co., Ltd., Tokyo (JP)

( * ) Notice: Subject to any disclaimer, the term of this patent is extended or adjusted under 35 U.S.C. 154(b) by 298 days.

(21) Appl. No.: 12/495,112

(22) Filed: Jun. 30, 2009

(65) Prior Publication Data

US 2010/0007566 A1 Jan. 14, 2010

(30) Foreign Application Priority Data

Jul. 8, 2008 (JP) ..... 2008-178412

(51) Int. Cl.
*H01Q 1/32* (2006.01)
*H01Q 1/12* (2006.01)

(52) U.S. Cl.
CPC ..... *H01Q 1/1214* (2013.01); *H01Q 1/3275* (2013.01)
USPC ..... 343/713; 248/206.2

(58) Field of Classification Search
CPC ..... H01Q 1/1214; H01Q 1/3275
USPC ..... 343/711, 713, 715, 892; 248/363
See application file for complete search history.

(56) References Cited

U.S. PATENT DOCUMENTS 3,659,678 A * 5/1972 Hall, Jr. ..... 248/363
4,019,203 A 4/1977 Yamanashi et al.
4,490,003 A 12/1984 Robinson
4,563,659 A 1/1986 Sakamoto
4,781,623 A 11/1988 Philippson et al.
4,866,407 A 9/1989 Ikeda
5,195,014 A 3/1993 Krantz, Jr. et al.
5,198,958 A 3/1993 Krantz, Jr. et al.
5,363,114 A 11/1994 Shoemaker
5,525,071 A 6/1996 Obara et al.
5,565,877 A 10/1996 Du et al.
5,668,559 A 9/1997 Baro (Continued)

FOREIGN PATENT DOCUMENTS

CN 201041825 3/2008
CN 101049878 7/2009

(Continued)

OTHER PUBLICATIONS

WO PCT/JP2012/050527 Search Rep., Mar. 14, 2012, Harada Industry Co. Ltd.

*Primary Examiner* — Robert Karacsony
*Assistant Examiner* — Amal Patel
(74) *Attorney, Agent, or Firm* — Wells St. John P.S.

(57) ABSTRACT

The vehicle roof mount antenna to be detachably mounted on a vehicle roof is mainly constituted by an antenna cover 1, an antenna base 2, a boss 3, a pad 4, an annular rib 5, and an annular groove portion 6. The pad 4 has a boss hole 7 through which the boss 3 penetrates and is disposed between the antenna base 2 and the vehicle roof R. The annular rib 5, which is made of an elastic material, is provided on the vehicle roof R side surface of the pad 4. When the vehicle roof mount antenna is fixed to the vehicle roof R, the annular rib 5 is inclined from the boss hole 7 toward a periphery of the pad 4. The annular groove portion 6 is provided at a position where the pressing force of the annular rib 5 against the vehicle roof R can be reduced.

23 Claims, 4 Drawing Sheets

(56) References Cited

U.S. PATENT DOCUMENTS

| | | | | |
|---|---|---|---|---|
| 5,732,440 | A * | 3/1998 | Wright | 16/2.2 |
| 5,757,327 | A | 5/1998 | Yajima et al. | |
| 5,797,771 | A | 8/1998 | Garside | |
| 5,995,064 | A | 11/1999 | Yanagisawa et al. | |
| 6,175,080 | B1 | 1/2001 | Nightingale | |
| 6,177,911 | B1 | 1/2001 | Yuda et al. | |
| 6,310,586 | B1 | 10/2001 | Takahashi et al. | |
| 6,486,842 | B2 | 11/2002 | Wang | |
| 6,501,427 | B1 | 12/2002 | Lilly et al. | |
| 6,747,603 | B1 * | 6/2004 | Tornatta et al. | 343/715 |
| 6,879,301 | B2 * | 4/2005 | Kozlovski | 343/878 |
| 6,940,366 | B2 | 9/2005 | Komiya | |
| 7,019,701 | B2 * | 3/2006 | Ohno et al. | 343/715 |
| 7,037,144 | B2 | 5/2006 | Wang et al. | |
| 7,148,850 | B2 | 12/2006 | Puente Baliarda et al. | |
| 7,156,678 | B2 | 1/2007 | Feldman et al. | |
| 7,164,386 | B2 | 1/2007 | Baliarda et al. | |
| 7,170,459 | B1 | 1/2007 | McKim | |
| 7,202,822 | B2 | 4/2007 | Baliarda et al. | |
| 7,210,965 | B1 | 5/2007 | Zhong et al. | |
| 7,271,773 | B2 * | 9/2007 | Gorai et al. | 343/711 |
| 7,312,761 | B2 | 12/2007 | Gorai et al. | |
| 7,394,438 | B2 | 7/2008 | Forster et al. | |
| 7,414,588 | B2 * | 8/2008 | Tateno | 343/713 |
| 7,420,517 | B2 | 9/2008 | Oshima et al. | |
| 7,554,490 | B2 | 6/2009 | Baliarda et al. | |
| 7,598,913 | B2 | 10/2009 | Rao et al. | |
| 7,671,504 | B2 | 3/2010 | Rohrer et al. | |
| 7,845,983 | B2 | 12/2010 | Kawada et al. | |
| 7,868,834 | B2 | 1/2011 | Ortigosa et al. | |
| 7,928,913 | B2 | 4/2011 | Kaneda et al. | |
| 7,952,533 | B2 | 5/2011 | Hur et al. | |
| 7,961,065 | B2 | 6/2011 | Kobayashi et al. | |
| 8,207,893 | B2 | 6/2012 | Baliarda et al. | |
| 8,212,726 | B2 | 7/2012 | Baliarda et al. | |
| 8,471,772 | B2 | 6/2013 | Baliarda et al. | |
| 8,497,807 | B2 | 7/2013 | Wakui et al. | |
| 8,502,742 | B2 | 8/2013 | Wakui et al. | |
| 8,605,002 | B2 | 12/2013 | Nishi et al. | |
| 2001/0022716 | A1 | 9/2001 | Glaser et al. | |
| 2001/0050649 | A1 | 12/2001 | Wang | |
| 2002/0021254 | A1 | 2/2002 | Wang et al. | |
| 2002/0050873 | A1 | 5/2002 | Tsunoda et al. | |
| 2002/0080088 | A1 | 6/2002 | Boyle | |
| 2003/0058186 | A1 | 3/2003 | Saito et al. | |
| 2003/0112191 | A1 | 6/2003 | Maeda et al. | |
| 2003/0228806 | A1 | 12/2003 | Wang et al. | |
| 2004/0090366 | A1 | 5/2004 | Wong et al. | |
| 2004/0119644 | A1 | 6/2004 | Puente-Baliarda et al. | |
| 2004/0233108 | A1 | 11/2004 | Bordi | |
| 2005/0195112 | A1 | 9/2005 | Baliarda et al. | |
| 2005/0200530 | A1 | 9/2005 | Aikawa et al. | |
| 2005/0231427 | A1 | 10/2005 | Baliarda et al. | |
| 2005/0264453 | A1 | 12/2005 | Baliarda et al. | |
| 2006/0040562 | A1 | 2/2006 | Funatsu | |
| 2006/0097937 | A1 | 5/2006 | Gorai et al. | |
| 2006/0187131 | A1 | 8/2006 | Oshima | |
| 2006/0232488 | A1 | 10/2006 | Wang et al. | |
| 2006/0274472 | A1 | 12/2006 | Saito et al. | |
| 2006/0290587 | A1 | 12/2006 | Forster et al. | |
| 2007/0152886 | A1 | 7/2007 | Baliarda et al. | |
| 2007/0279302 | A1 * | 12/2007 | Byrne et al. | 343/713 |
| 2008/0117111 | A1 | 5/2008 | Ikeda et al. | |
| 2008/0198082 | A1 | 8/2008 | Soler Castany et al. | |
| 2009/0109101 | A1 | 4/2009 | Baliarda et al. | |
| 2009/0115551 | A1 | 5/2009 | Kobayashi et al. | |
| 2009/0140927 | A1 | 6/2009 | Maeda et al. | |
| 2009/0153404 | A1 | 6/2009 | Ryou et al. | |
| 2009/0156059 | A1 | 6/2009 | Zhu et al. | |
| 2009/0207084 | A1 | 8/2009 | Ikeda et al. | |
| 2009/0237313 | A1 | 9/2009 | Martinez Ortigosa | |
| 2009/0267847 | A1 | 10/2009 | Sato et al. | |
| 2009/0280688 | A1 | 11/2009 | Kawada et al. | |
| 2009/0284441 | A1 | 11/2009 | Wakui et al. | |
| 2009/0295645 | A1 | 12/2009 | Campero et al. | |
| 2009/0303134 | A1 | 12/2009 | Baliarda et al. | |
| 2010/0009565 | A1 | 1/2010 | Wang | |
| 2010/0245189 | A1 | 9/2010 | Wang | |
| 2010/0265145 | A1 | 10/2010 | Chung | |
| 2010/0265147 | A1 | 10/2010 | Wakui et al. | |
| 2010/0277380 | A1 | 11/2010 | Breden et al. | |
| 2011/0074524 | A1 | 3/2011 | Nishioka | |
| 2011/0102269 | A1 | 5/2011 | Sato et al. | |
| 2011/0177839 | A1 | 7/2011 | Baliarda et al. | |
| 2011/0181478 | A1 | 7/2011 | Baliarda et al. | |
| 2011/0181481 | A1 | 7/2011 | Baliarda et al. | |
| 2011/0260934 | A1 | 10/2011 | Ilno et al. | |
| 2012/0326934 | A1 | 12/2012 | Wakui et al. | |
| 2013/0176180 | A1 | 7/2013 | Wakui et al. | |

FOREIGN PATENT DOCUMENTS

| | | |
|---|---|---|
| DE | 60105892 | 10/2005 |
| EP | 1143557 | 10/2001 |
| EP | 1182885 | 12/2001 |
| JP | S55-138913 | 10/1980 |
| JP | S59-078711 | 5/1984 |
| JP | S60-126963 | 7/1985 |
| JP | 2-32223 | 2/1990 |
| JP | H04-257111 | 9/1992 |
| JP | H05-039009 | 2/1993 |
| JP | H05-058223 | 3/1993 |
| JP | H05-191124 | 7/1993 |
| JP | H06-203897 | 7/1994 |
| JP | H06-276013 | 9/1994 |
| JP | 7-36381 | 4/1995 |
| JP | H07-176929 | 7/1995 |
| JP | H07-272942 | 10/1995 |
| JP | H09-213528 | 8/1997 |
| JP | H09-232851 | 9/1997 |
| JP | H10-056315 | 2/1998 |
| JP | H11-040920 | 2/1999 |
| JP | 2000-353573 | 12/2000 |
| JP | 2001-127522 | 5/2001 |
| JP | 2001-291540 | 10/2001 |
| JP | 2001-345613 | 12/2001 |
| JP | 2002-359514 | 12/2002 |
| JP | 2003-521146 | 7/2003 |
| JP | 2003-264043 | 9/2003 |
| JP | 2004-031068 | 1/2004 |
| JP | 2004-082749 | 3/2004 |
| JP | 2004-153502 | 5/2004 |
| JP | 2004-159153 | 6/2004 |
| JP | 2004-516700 | 6/2004 |
| JP | 2005-102031 | 4/2005 |
| JP | 2005-110200 | 4/2005 |
| JP | 2006-033172 | 2/2006 |
| JP | 2006-059646 | 3/2006 |
| JP | 2006-108848 | 4/2006 |
| JP | 2006-121369 | 5/2006 |
| JP | 2006-166041 | 6/2006 |
| JP | 2006-178647 | 6/2006 |
| JP | 2006-186881 | 7/2006 |
| JP | 2007-036354 | 2/2007 |
| JP | 2007-072952 | 3/2007 |
| JP | 2007-124892 | 5/2007 |
| JP | 2008/035479 | 2/2008 |
| JP | 2008-523671 | 7/2008 |
| JP | 2009-290377 | 12/2009 |
| JP | 2010-021856 | 1/2010 |
| JP | 2011-035519 | 2/2011 |
| WO | WO 01/31736 | 5/2001 |
| WO | WO 2007/020902 | 2/2007 |
| WO | PCT/JP2007/000505 | 5/2007 |
| WO | WO 2008/001482 | 1/2008 |
| WO | WO 2008/062746 | 5/2008 |
| WO | PCT/JP2010/058364 | 5/2010 |

* cited by examiner

VEHICLE ROOF MOUNT ANTENNA

RELATED APPLICATION

This application relates to and claims priority from Japanese Patent Application No. 2008-178412 filed on Jul. 8, 2008, the entire disclosure is incorporated herein by reference.

BACKGROUND OF THE INVENTION

1. Field of the Invention

The present invention relates to a vehicle roof mount antenna detachably mounted on a vehicle roof, and more particularly to a vehicle roof mount antenna improving waterproofness and dustproofness.

2. Description of the Related Art

A vehicle roof mount antenna typically has a pad on a contact surface with a vehicle roof. The pad has an annular rib (flange) made of an elastic material so as to improve waterproofness and dustproofness. The installation pressure of a boss brings the annular rib of the pad into press contact with the vehicle roof, thereby ensuring the waterproofness and dustproofness of the vehicle roof mount antenna.

For example, Patent Document 1 (Japanese Patent Application Kokai Publication No. 2005-102031) discloses an antenna for an automobile. The antenna has a pad in which a plurality of substantially triangular-shaped ribs are provided for waterproofness and thereby prevents entering of rain water and the like.

In such a vehicle roof mount antenna using a pad having an annular rib, when the installation pressure is used to bring the annular rib into press contact with the vehicle roof, the annular rib is deformed to be tightly attached to the vehicle roof. At this time, a pressing force corresponding to the deformation amount is given to the vehicle roof. When the pressing force is excessively large, a problem that the vehicle roof is deformed arises. Further, when the installation pressure of the boss is reduced so as not to cause the deformation of the vehicle roof, the waterproofness and the dustproofness which are the intended functions of the annular rib cannot be ensured satisfactorily.

Recently, a reduction in the weight of a vehicle body is now an important trend, and along with the weight reduction, the thickness of the vehicle roof has been reduced. Therefore, the problem of the deformation of the vehicle roof has become more prominent.

The vehicle roof typically has a slight curved surface shape, so that the deformation amount of the annular rib may become nonuniform throughout the entire circumference of the annular rib at some position on which the vehicle roof mount antenna is mounted. In particular, there is a gap between the annular rib that is away from the boss and the vehicle roof, so that satisfactory waterproofness and dustproofness cannot be ensured.

An object of the present invention, therefore, is to overcome the problems existing in the prior art, and to provide a roof mount antenna device which does not cause a vehicle roof to be deformed even when the vehicle roof on which the roof mount antenna device is mounted has a small thickness and which is capable of ensuring satisfactory waterproofness and dustproofness even when the vehicle roof on which the roof mount antenna device is mounted has a curved surface shape.

SUMMARY OF THE INVENTION

To achieve the above object, according to an aspect of the present invention, there is provided a vehicle roof mount antenna detachably mounted on a vehicle roof, comprising: an antenna cover; an antenna base covered by the antenna cover; a boss used for fixing the vehicle roof mount antenna to the vehicle roof; a pad having a boss hole through which the boss penetrates and disposed between the antenna base and the vehicle roof; an annular rib made of an elastic material and provided on the vehicle roof side surface of the pad, which is inclined from the boss hole toward a periphery of the pad in a state where the vehicle roof mount antenna is fixed to the vehicle roof; and an annular groove portion provided at a position where the pressing force of the annular rib against the vehicle roof can be reduced.

The annular groove portion may be provided in the pad at the inner peripheral edge and/or outer peripheral edge of the annular rib.

The annular rib may be provided at the peripheral edge of the boss hole, and the annular groove portion may be provided in the pad at the outer peripheral edge of the annular rib.

The annular rib may include a first rib provided at the peripheral edge of the boss hole and a second rib provided around the first rib, and the annular groove portion may include a first groove portion provided in the pad at the outer peripheral edge of the first rib and a second groove portion provided in the pad at the outer peripheral edge of the second rib.

The annular rib may further include a peripheral edge rib provided at the peripheral edge of the pad, and the annular groove portion may further include a peripheral edge groove portion provided in the pad at the inner peripheral edge of the peripheral edge rib.

The annular rib may have a cross-section of a tapered shape as viewed in the direction perpendicular to the surface of the pad on the vehicle roof side.

The annular rib may have a cross-section of a shed roof shape as viewed in the direction perpendicular to the surface of the pad on the vehicle roof side.

In a state where the vehicle roof mount antenna is fixed to the vehicle roof, the width of the annular groove portion may be designed such that the tip portion of the annular rib does not go over the annular groove portion and the depth thereof may be designed such that the annular rib does not contact the bottom portion of the annular groove portion.

In the vehicle roof mount antenna according to the present invention, the pressing force of the annular rib against the vehicle roof, which is applied when the annular rib is brought into press contact with the vehicle roof, can be reduced. Thus, even when the vehicle roof on which the roof mount antenna device is mounted has a small thickness, it is possible to prevent the vehicle roof from being deformed while ensuring waterproofness and dustproofness. Further, satisfactory waterproofness and dustproofness can be ensured even when the vehicle roof mount antenna is mounted on a vehicle roof having a curved surface shape.

PREFERRED EMBODIMENTS OF THE INVENTION

Figure 1:
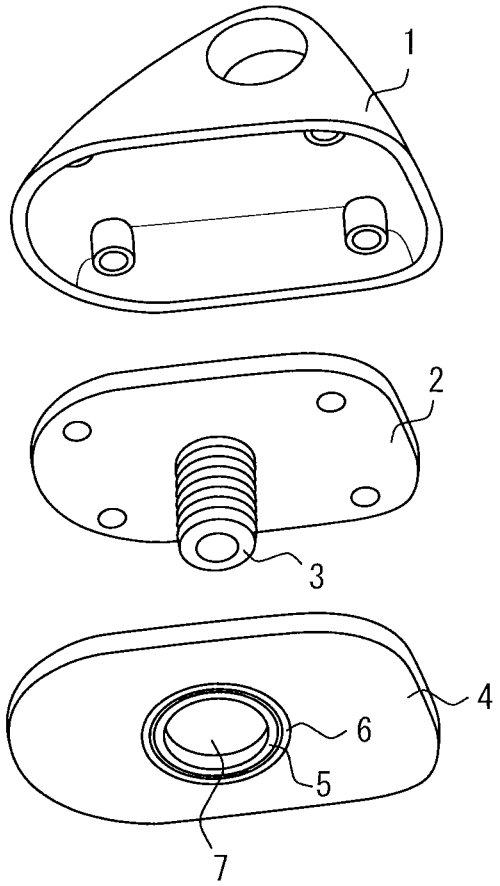
FIG. 1 is an exploded perspective view of a vehicle roof mount antenna according to a first embodiment of the present invention.
Figure 2:
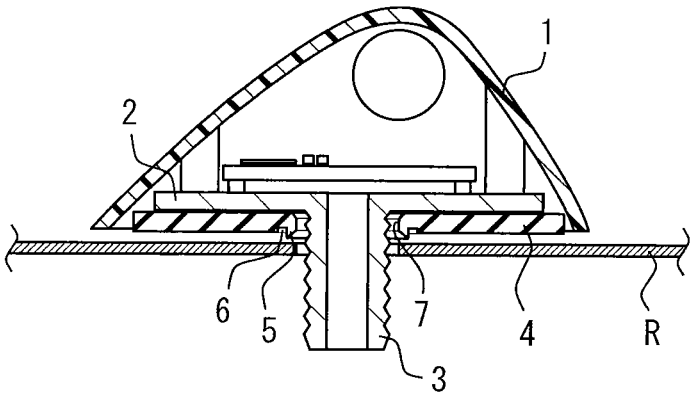
FIG. 2 is a vertical cross-sectional view of the vehicle roof mount antenna according to the first embodiment of the present invention.

Preferred embodiments of the present invention will be described below with reference to the accompanying drawings. FIG. 1 is an exploded perspective view of a vehicle roof mount antenna according to a first embodiment of the present invention. FIG. 2 is a vertical cross-sectional view of the vehicle roof mount antenna according to the first embodiment. As shown in the drawings, the vehicle roof mount antenna according to the present invention is mainly constituted by an antenna cover 1, an antenna base 2, a boss 3, a pad 4, an annular rib (flange) 5, and an annular groove portion 6.

The antenna cover 1 defines the appearance of the vehicle roof mount antenna according to the present invention. The shape of the antenna cover of the vehicle roof mount antenna according to the present invention is not limited to that shown in the drawings, but may be modified depending on the intended function or design.

The antenna base 2 is covered by the antenna cover 1. A circuit board, an antenna, and the like are mounted on the antenna base 2. The shape of the antenna base of the vehicle roof mount antenna according to the present invention is not limited to that shown in the drawings, but may be modified depending on the shape of the antenna cover.

The boss 3 is a member used for fixing the vehicle roof mount antenna according to the present invention to a vehicle roof R. For example, the boss 3 is so formed as to protrude from the antenna base 2, as shown in the drawings. However, the configuration of the boss of the vehicle roof mount antenna according to the present invention is not limited to this, but may be so formed as to protrude from the antenna cover. The boss 3 is inserted into a hole formed in the vehicle roof R and is fixed by a bolt or the like (not shown) from the vehicle interior side, whereby the vehicle roof mount antenna is fixed to the vehicle roof R. The boss 3 has a hollow structure and is used also for introducing a cable or the like into the inside of the vehicle.

The pad 4 has a boss hole 7 through which the boss 3 penetrates and is disposed between the antenna base 2 and the vehicle roof R. The pad 4 is commonly made of an elastic material. However, only the portion corresponding to the annular rib 5 may be made of an elastic material. The pad may cover not only the bottom portion of the antenna base but also the peripheral portion thereof.

The annular rib 5, which is made of an elastic material as described above, is provided on the vehicle roof R side surface of the pad 4. When the vehicle roof mount antenna according to the present invention is fixed to the vehicle roof R, the annular rib 5 is inclined from the boss hole 7 toward a periphery of the pad 4. The specific shape of the annular rib will be described later.

The annular groove portion 6 is provided at a position where the pressing force of the annular rib 5 against the vehicle roof R can be reduced. In the example shown in the drawings, the annular groove portion 6 is provided at the outer peripheral edge at which the annular rib 5 is provided. However, the position at which the annular groove portion 6 of the vehicle roof mount antenna according to the present invention is provided is not limited to the position shown in the drawings, but the annular groove portion 6 may be provided at any position as long as it can reduce the pressing force that the annular rib 5 applies to the vehicle roof. Further, although the cross-section of the annular groove portion 6 as viewed in the direction perpendicular to the surface of the pad 4 on the vehicle roof R side is rectangular in the example shown in the drawings, it is not limited to the rectangular shape but may be a V-shape, a U-shape, or the like.

Figure 3:
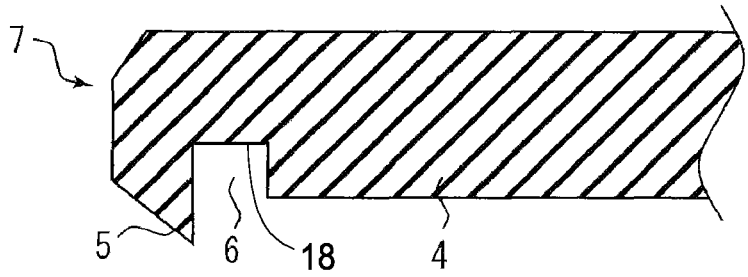
FIG. 3 is a partially enlarged view showing an annular rib and an annular groove portion provided around a boss hole in the vehicle roof mount antenna according to the first embodiment.

With reference to FIG. 3, a more detailed structure of the vehicle roof mount antenna according to the present invention will be described. FIG. 3 is a partially enlarged view showing the annular rib and the annular groove portion provided around the boss hole in the vehicle roof mount antenna according to the first embodiment. As shown in FIG. 3, the annular rib 5 is provided at the periphery of the boss hole 7. The annular groove portion 6 is provided at the outer peripheral edge of the annular rib 5. Annular groove portion 6 includes a bottommost surface 18. In an example shown in the drawings, the annular rib 5 has a cross-section of a shed roof shape as viewed in the direction perpendicular to the surface of the pad 4 on the vehicle roof R side. In the case where the annular rib 5 has the shed roof shape having an inclined surface inclined toward the boss hole 7 side, when the annular rib 5 is brought into press contact with the vehicle roof 5, it is crushed to be deformed toward the peripheral edge of the pad 4.

A pressing force corresponding to the deformation amount obtained when the annular rib 5 is crushed becomes smaller as the length of the annular rib 5 from its base to tip becomes larger. In the present invention, the annular groove portion 6 is provided at the outer peripheral edge of the annular rib 5 as described above, so that the length of the annular rib 5 from its base to tip can be increased without changing its height from the surface of the pad 4. Thus, according to the present invention, it is possible to reduce the pressing force corresponding to the deformation amount of the annular rib 5 while reducing the protrusion amount of the annular rib 5 from the surface of the pad 4.

Figure 4:
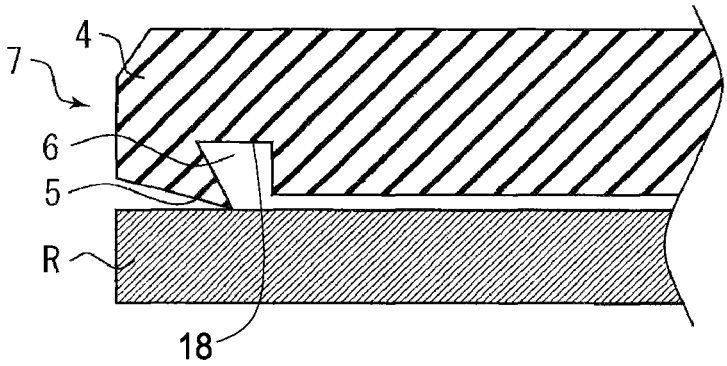
FIG. 4 is a partially enlarged view showing the annular rib and the annular groove portion in a state where the vehicle roof mount antenna according to the present invention is fixed to the vehicle roof.

As described above, when the vehicle roof mount antenna according to the present invention is fixed to the vehicle roof, the annular rib is brought into press contact with the vehicle roof. This state will be described with reference to FIG. 4. FIG. 4 is a partially enlarged view showing the annular rib and the annular groove portion in a state where the vehicle roof mount antenna according to the present invention has been fixed to the vehicle roof. When being brought into press contact with the vehicle roof R, the annular rib 5 having the configuration as described above is crushed to be deformed toward the pad peripheral edge. At this time, the deformed annular rib 5 enters the annular groove portion 6 provided at the outer peripheral edge of the annular rib 5. As shown in FIG. 4, the width of the annular groove portion 6 is designed such that the tip portion of the annular rib 5 does not go over the annular groove portion 6, and the depth thereof is designed such that the annular rib 5 does not contact the bottom portion of the annular groove portion 6. Annular groove portion 6 includes a bottommost surface 18. Thus, the annular groove portion 6 serves as an escape margin for the annular rib 5, which can also reduce the pressing force of the annular rib 5 against the vehicle roof R. By designing the a cross-section of the annular groove portion 6 as viewed in the direction perpendicular to the surface of the pad 4 on the vehicle roof R side in such a shape, it is possible to reduce the pressing force of the annular rib 5.

Figure 5:
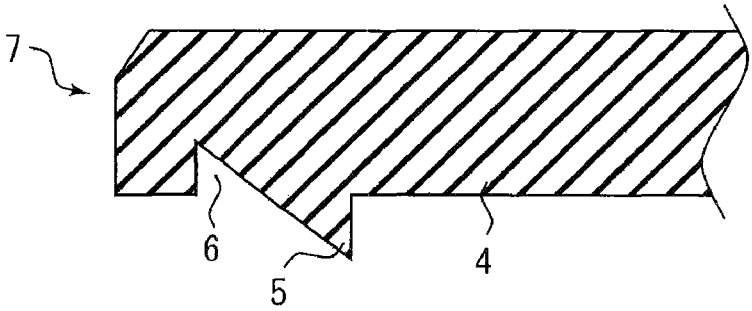
FIG. 5 is a partially enlarged view of the annular rib and the annular groove portion of the vehicle roof mount antenna according to the present invention, which is used for explaining another arrangement example of the annular groove portion.

With reference to FIG. 5, another configuration example of the annular groove portion of the vehicle roof mount antenna according to the present invention will be described. FIG. 5 is a partially enlarged view showing the annular rib and the annular groove portion of the vehicle roof mount antenna according to the present invention. The annular groove portion 6 shown in FIG. 5 is provided at the inner peripheral edge of the annular rib 5. Although a V-shaped annular groove portion is shown in the drawing, the shape of the annular groove portion is not limited to this, but the annular groove portion may have any shape as long as the pressing force of the annular rib against the vehicle roof can be reduced.

As shown in FIG. 5, when the annular rib 5 is crushed to be deformed, it is compressed on the peripheral edge side of the pad 4 and extended on the boss hole side. When the annular groove portion 6 is provided as shown in the drawing, both the inclined portion of the annular rib 5 and the groove wall of the annular groove portion 6 are extended. Thus, the size of the portion to be extended is increased, with the result that it is possible to reduce the pressing force of the annular rib 5 against the vehicle roof R.

Figure 6:
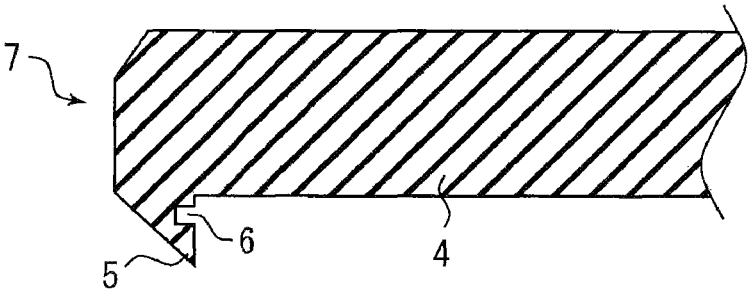
FIG. 6 is a partially enlarged view of the annular rib and the annular groove portion of the vehicle roof mount antenna according to the present invention, which is used for explaining still another arrangement example of the annular groove portion.

With reference to FIG. 6, still another configuration example of the annular groove portion of the vehicle roof mount antenna according to the present invention will be described. FIG. 6 is a partially enlarged view showing the annular rib and the annular groove portion of the vehicle roof mount antenna according to the present invention. As shown in FIG. 6, the annular groove portion 6 may be provided in the annular rib 5. Also in this configuration, when the annular rib 5 is brought into press contact with the vehicle roof R and is crushed to be deformed toward the peripheral edge of the pad 4, the annular groove portion 6 serves as a crush margin, so that it is possible to reduce the pressing force of the annular rib 5 against the vehicle roof R.

The installation position of the annular groove portion of the vehicle roof mount antenna according to the present invention is not limited to the positions shown in the above drawings, but may be positioned at any suitable position as long as the pressing force of the annular rib against the vehicle roof can be reduced.

Figure 7:
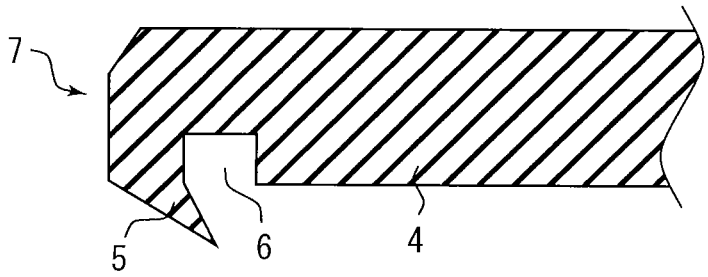
FIG. 7 is a partially enlarged view of the annular rib and the annular groove portion of the vehicle roof mount antenna according to the present invention, which is used for explaining another configuration example of the annular rib.

With reference to FIG. 7, another configuration example of the annular rib of the vehicle roof mount antenna according to the present invention will be described. FIG. 7 is a partially enlarged view showing the annular rib and the annular groove portion of the vehicle roof mount antenna according to the present invention. Although the annular rib has a cross-section of a shed roof shape as viewed in the direction perpendicular to the surface of the pad 4 on the vehicle roof R side in the above examples, the present invention is not limited to this. That is, as shown in FIG. 7, the annular rib 5 may just have a cross-section of a tapered shape as viewed in the direction perpendicular to the surface of the pad 4 on the vehicle roof R side, which is inclined toward the periphery of the pad. Even with such a configuration, the same effect as in the examples described above can be obtained.

Figure 8:
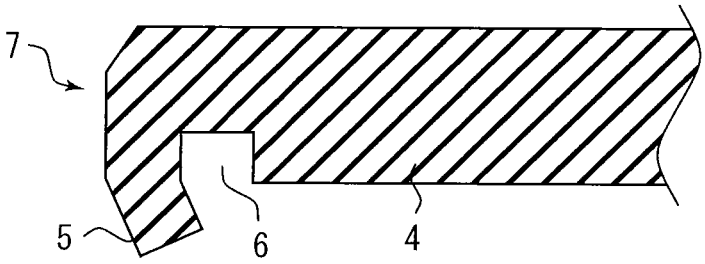
FIG. 8 is a partially enlarged view of the annular rib and the annular groove portion of the vehicle roof mount antenna according to the present invention, which is used for explaining still another configuration example of the annular rib.

With reference to FIG. 8, another configuration of the annular rib of the vehicle roof mount antenna according to the present invention will be described. FIG. 8 is a partially enlarged view showing the annular rib and the annular groove portion of the vehicle roof mount antenna according to the present invention. As shown in FIG. 8, the annular rib 5 may have a cross-section of a rectangular shape as viewed in the direction perpendicular to the surface of the pad 4 on the vehicle roof R side, which is inclined toward the periphery of the pad.

The cross-sectional shape of the annular rib of the vehicle roof mount antenna according to the present invention is not limited to the shapes shown in the above examples, but the annular rib may have any cross-sectional shape as long as it has a shape inclined toward the periphery of the pad.

As described above, according to the roof mount antenna device of the present invention, it is possible to reduce the pressing force corresponding to the deformation amount of the annular rib as compared to a case where an annular rib used in a conventional roof mount antenna device is used. Thus, with the use of the vehicle roof mount antenna according to the present invention, a problem that the vehicle roof is deformed can be solved.

Figure 9:
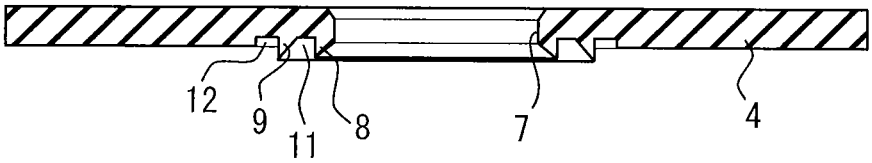
FIG. 9 is a vertical cross-sectional view of the pad of a vehicle roof mount antenna according to a second embodiment of the present invention.

Next, a vehicle roof mount antenna according to a second embodiment of the present invention will be described with reference to FIG. 9. FIG. 9 is a vertical cross-sectional view of the pad of the vehicle roof mount antenna according to the second embodiment of the present invention. Since the configurations of the antenna cover, antenna base, boss, and the like are the same as those shown in FIGS. 1 and 2, the descriptions thereof are omitted here. As shown in FIG. 9, the annular rib of the vehicle roof mount antenna according to the second embodiment includes a first rib 8 provided at the peripheral edge of the boss hole 7 and a second rib 9 provided around the first rib 8. Further, the annular groove portion includes a first groove portion 11 provided in the pad 4 at the outer peripheral edge of the first rib 8 and a second groove portion 12 provided in the pad 4 at the outer peripheral edge of the second rib 9. By providing two ribs and two groove portions around the boss hole 7, it is possible to further increase waterproofness and dustproofness.

Although the second rib 9 is provided continuously from the first groove portion 11 in the vehicle roof mount antenna according to the second embodiment shown in FIG. 9, the present invention is not limited to this, but the second rib 9 may be provided at a position apart from the first groove portion. However, in the case where the second rib is provided continuously from the first groove portion as shown in FIG. 9, the first groove portion serves as an escape margin for the first rib, as well as the length of the second rib from its base to tip can be increased. That is, in this case, two effects can be produced with a single groove (first groove portion), making it possible to reduce the pressing force against the vehicle roof.

Although both the first and the second ribs 8 and 9 have a cross-section of the shed roof shape as viewed in the direction perpendicular to the surface of the pad 4 on the vehicle roof R side in FIG. 9, they may have another shape such as one shown in FIG. 7 or FIG. 8. Further, both the first and the second groove portions may be arranged in another manner like the arrangement example shown in FIG. 5 or FIG. 6.

Figure 10:
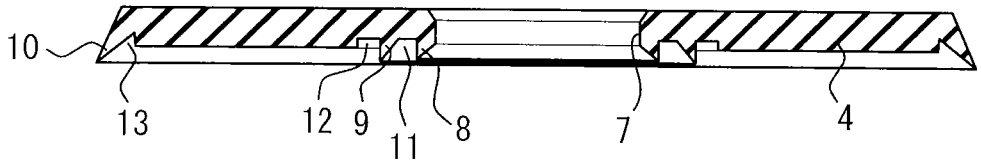
FIG. 10 is a vertical cross-sectional view of the pad of a vehicle roof mount antenna according to a third embodiment of the present invention.

Next, a vehicle roof mount antenna according to a third embodiment of the present invention will be described with reference to FIG. 10. FIG. 10 is a vertical cross-sectional view of the pad of the vehicle roof mount antenna according to the third embodiment of the present invention. As in the case of the second embodiment, since the configurations of the antenna cover, antenna base, boss, and the like are the same as those shown in FIGS. 1 and 2, the descriptions thereof are omitted here. As shown in FIG. 10, the pad 4 of the vehicle roof mount antenna according to the third embodiment further has a peripheral edge rib 10 and a peripheral edge groove portion 13 in addition to the ribs and the groove portions provided in the pad 4 of the vehicle roof mount antenna according to the second embodiment shown in FIG. 9. The peripheral edge rib 10 is provided at the peripheral edge of the pad 4. The peripheral edge groove portion 13 is provided at the inner peripheral edge of the peripheral edge rib 10. That is, the first rib 8, the second rib 9, the peripheral edge rib 10, the first groove portion 11, the second groove portion 12, and the peripheral edge groove portion 13 are provided in the pad 4 of the vehicle roof mount antenna according to the third embodiment. With this configuration, it is possible to prevent entering of water or dust also at the peripheral edge of the pad 4, resulting in a further increase in waterproofness and dustproofness throughout the entire body of the vehicle roof mount antenna.

Further, as described above, in the case where the annular rib of the vehicle roof mount antenna according to the present invention is used, the pressing force corresponding to the deformation amount obtained when the annular rib is tightly attached to the vehicle roof can be reduced to a smaller level. Therefore, it is possible to set the deformation amount of the annular rib to a larger level than in the case where an annular rib of a conventional vehicle roof mount antenna is used. Thus, even if the deformation amount of the annular rib becomes nonuniform throughout the entire circumference of the annular rib when the vehicle roof mount antenna is mounted on the vehicle roof having a curved surface shape, there is no gap between the annular rib and the vehicle roof, so that satisfactory waterproofness and dustproofness can be ensured. This is particularly effective for the peripheral edge rib arranged at the farthermost position from the boss hole.

The length of the annular rib of the vehicle roof mount antenna according to the present invention is the length from the bottom of the annular groove portion to the tip of the annular rib. That is, by providing the annular groove portion, it is possible to increase the length of the annular rib from its base to tip while reducing the protrusion amount from the pad surface. Thus, even when the deformation amount of the annular rib is set to a larger value, it is also possible to reduce the height of the vehicle roof mount antenna.

Figure 11:
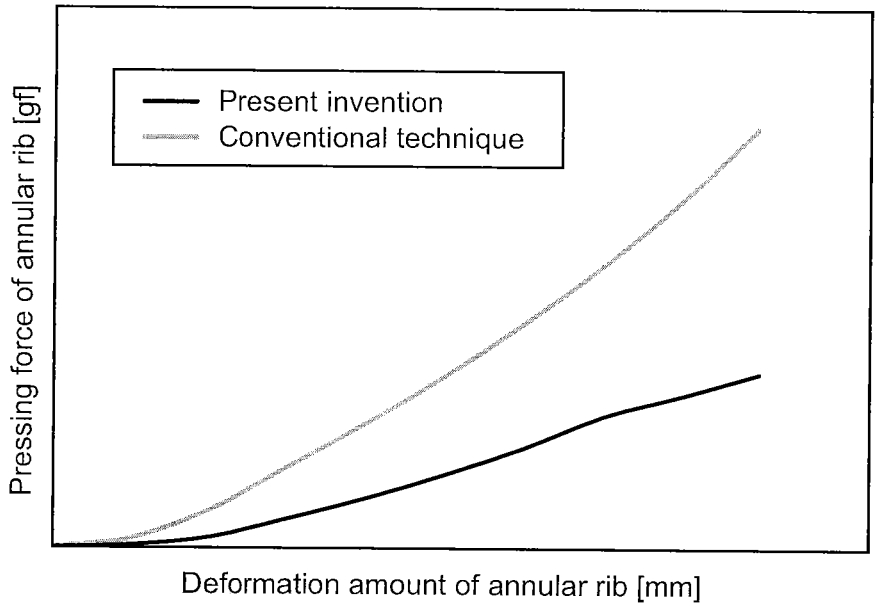
FIG. 11 is a graph showing change characteristics of the pressing force of the annular rib of the vehicle roof mount antenna according to the present invention relative to the deformation amount thereof.

Next, change characteristics of the pressing force of the annular rib of the vehicle roof mount antenna according to the present invention relative to the deformation amount thereof will be described with reference to FIG. 11. FIG. 11 is a graph showing change characteristics of the pressing force of the annular rib of the vehicle roof mount antenna according to the present invention relative to the deformation amount thereof. As a comparative example, change characteristics of the pressing force of a conventional vehicle roof mount antenna are shown by a grey line. The change characteristics shown by the graph are merely an example and it should be understood that it changes depending on the length or hardness of the annular rib.

As is clear from FIG. 11, in the case where the pressing forces are compared between the annular rib of the present invention and the conventional annular rib under the condition that the deformation amounts thereof are the same, the pressing force of the annular rib according to the present invention is smaller. Further, as is clear from the same graph, in the case where the deformation amounts are compared between the annular rib of the present invention and the conventional annular rib under the condition that the pressing forces thereof are the same, the deformation amount of the annular rib according to the present invention is larger.

Since the pressing force of the annular rib against the vehicle roof is smaller as compared to that of the annular rib of the conventional vehicle roof mount antenna, it is possible to reduce the deformation of the vehicle roof as compared to the case where the conventional vehicle roof mount antenna is used. Further, it is possible to set the deformation amount of the annular rib to a larger level than in the case where an annular rib of the conventional vehicle roof mount antenna is used, thereby preventing the annular rib from being separated from the vehicle roof, with the result that satisfactory waterproofness and dustproofness can be ensured.

The vehicle roof mount antenna according to the present invention is not limited to the examples shown by the drawings, but various changes may be made without departing from the scope of the invention. For example, the number of the annular ribs and the annular groove portions to be provided in the pad may be increased. Further, the shapes of the annular rib or arrangement positions of the annular rib shown in the examples described above may be combined in various ways.

What is claimed is:

1. A vehicle roof mount antenna detachably mounted on a vehicle roof, comprising:

an antenna cover;

an antenna base covered by the antenna cover;

a boss used for fixing the vehicle roof mount antenna to the vehicle roof;

a pad having a boss hole through which the boss penetrates and disposed between the antenna base and the vehicle roof;

an annular rib made of an elastic material and provided on the vehicle roof side surface of the pad so as to protrude from the vehicle roof side surface of the pad at the peripheral edge of the boss hole, which is inclined from the boss hole toward a periphery of the pad in a state where the vehicle roof mount antenna is fixed to the vehicle roof;

an annular groove portion provided as an escape margin of the annular rib in a form of depression of the vehicle roof side surface of the pad at a position where the pressing force of the annular rib against the vehicle roof can be reduced, wherein the annular groove portion is configured to increase a length of the annular rib from its base to tip without changing its height from a surface of the pad; and in a state where the vehicle roof mount antenna is fixed to the vehicle roof, the width of the annular groove portion is designed such that a tip portion of the annular rib does not go over the annular groove portion and the depth thereof is designed such that the annular rib does not contact a bottom portion of the annular groove portion.

2. The vehicle roof mount antenna according to claim 1, in which the annular groove portion is provided in the pad at the inner peripheral edge of the annular rib.

3. The vehicle roof mount antenna according to claim 1, in which the annular rib is provided at the peripheral edge of the boss hole, and the annular groove portion is provided in the pad at the outer peripheral edge of the annular rib.

4. The vehicle roof mount antenna according to claim 1, in which the annular rib includes a first rib provided at the peripheral edge of the boss hole and a second rib provided around the first rib, and the annular groove portion includes a first groove portion provided in the pad at the outer peripheral edge of the first rib and a second groove portion provided in the pad at the outer peripheral edge of the second rib.

5. The antenna of claim 1 wherein the vehicle roof side surface of the pad extends from the annular groove portion to an outermost sidewall of the pad.

6. The antenna of claim 1 wherein the vehicle roof side surface of the pad is planar and oriented to be parallel with the roof of the vehicle.

7. The antenna of claim 1 wherein the boss hole is established by a peripheral sidewall surface that extends to establish a sidewall surface of the annular rib collectively as a single wall surface.

8. The antenna of claim 1 wherein the vehicle roof side surface of the pad is planar and extends generally perpendicularly to a sidewall surface of the annular groove portion.

9. The antenna of claim 1 wherein:

the annular groove portion comprises a planar bottommost surface; and the vehicle roof side surface of the pad comprises a planar configuration parallel to the planar bottommost surface of the annular groove portion.

10. The vehicle roof mount antenna according to claim 3, in which the annular rib further includes a peripheral edge rib provided at the peripheral edge of the pad, and the annular groove portion further includes a peripheral edge groove portion provided in the pad at the inner peripheral edge of the peripheral edge rib.

11. A vehicle roof mount antenna comprising:

a support having a first side comprising an antenna and an opposite second side comprising a boss configured to releasably secure the support to a vehicle roof; and an annular elastic structure surrounding the boss and configured to be compressed between the second side of the support and the vehicle roof, the annular elastic structure comprising:

a surface configured to be received proximate the vehicle roof;

an annular flange extending outwardly from the surface; and an annular groove extending inwardly into the annular flange, wherein the annular groove extends only into the annular flange.

12. The antenna of claim 11 wherein the surface of the annular elastic structure is planar and oriented to be parallel with the roof of the vehicle.

13. The antenna of claim 11 wherein a portion of the annular elastic structure that surrounds the boss comprises a peripheral sidewall surface that extends to establish a sidewall surface of the annular flange collectively as a single wall surface.

14. The antenna of claim 11 wherein the surface of the annular elastic structure is planar and extends generally parallel to a sidewall surface of the annular groove.

15. The antenna of claim 11 wherein:

the annular groove comprises a planar bottommost surface; and the surface of the annular elastic structure comprises a planar configuration perpendicular to the planar bottommost surface of the annular groove.

16. The antenna of claim 11 wherein an entirety of the annular groove is spaced from the surface of the annular elastic structure.

17. The antenna of claim 11 wherein the annular groove extending inwardly comprises the annular groove extending toward the boss.

18. The antenna of claim 11 wherein the annular groove comprises sidewalls that extend parallel with the surface of the annular elastic structure.

19. A vehicle roof mount antenna comprising:

an antenna base comprising a boss configured for securing the vehicle roof mount antenna to a vehicle roof; and a pad having a boss hole through which the boss penetrates and is disposed between the antenna base and the vehicle roof, the pad comprising:

a surface configured to be received opposite the vehicle roof;

an annular groove extending from the surface into the pad; and at least one annular rib extending outwardly from the surface and outwardly from the annular groove, wherein in a state where the vehicle roof mount antenna is fixed to the vehicle roof, the annular rib and the annular groove are configured so that the annular rib does not contact a bottom portion of the annular groove, all annular rib structures being located proximate the boss hole.

20. The antenna of claim 19 wherein the surface of the pad is planar and oriented to be parallel with the roof of the vehicle.

21. The antenna of claim 19 wherein the boss hole is established by a peripheral sidewall surface that extends to establish a sidewall surface of the annular rib collectively as a single wall surface.

22. The antenna of claim 19 wherein the surface of the pad is planar and extends generally perpendicularly to a sidewall surface of the annular groove.

23. The antenna of claim 19 wherein:

the annular groove comprises a planar bottommost surface; and the surface of the pad comprises a planar configuration parallel to the planar bottommost surface of the annular groove.

* * * * *

UNITED STATES PATENT AND TRADEMARK OFFICE

CERTIFICATE OF CORRECTION

PATENT NO. : 8,941,544 B2
APPLICATION NO. : 12/495112
DATED : January 27, 2015
INVENTOR(S) : Hidekazu Kobayashi et al.

It is certified that error appears in the above-identified patent and that said Letters Patent is hereby corrected as shown below:

Title Page 2, under (56) Foreign Patent Documents:
Replace "EP 1182885 12/2001" with --EP 1162685 12/2001--

Specification

Column 5, line 19-20 – Replace "By designing the a cross-section of" with
--By designing a cross-section of--

Signed and Sealed this
First Day of March, 2016

Michelle K. Lee

Michelle K. Lee
*Director of the United States Patent and Trademark Office*